US011713934B2

(12) United States Patent
Rosset

(10) Patent No.: US 11,713,934 B2
(45) Date of Patent: Aug. 1, 2023

(54) ADJUSTABLE PILLARS FOR RIFLE BOTTOM METAL

(71) Applicant: TELEIOS MANUFACTURING, Jacksonville, FL (US)

(72) Inventor: Mark Rosset, Jacksonville, FL (US)

(73) Assignee: TELEIOS MANUFACTURING, Jacksonville, FL (US)

( * ) Notice: Subject to any disclaimer, the term of this patent is extended or adjusted under 35 U.S.C. 154(b) by 0 days.

(21) Appl. No.: 17/849,131

(22) Filed: Jun. 24, 2022

(65) Prior Publication Data

US 2022/0412679 A1 Dec. 29, 2022

Related U.S. Application Data

(60) Provisional application No. 63/214,463, filed on Jun. 24, 2021.

(51) Int. Cl.
*F41A 3/66* (2006.01)

(52) U.S. Cl.
CPC ..... *F41A 3/66* (2013.01)

(58) Field of Classification Search
CPC ..... F41A 3/66; F41A 11/04
USPC ..... 42/75.03, 75.01, 71.01
See application file for complete search history.

(56) References Cited

U.S. PATENT DOCUMENTS

| | | | | |
|---|---|---|---|---|
| 2,967,368 | A * | 1/1961 | Williams | F41A 21/482 42/75.01 |
| 8,578,643 | B2 * | 11/2013 | Hasler | F41A 21/485 42/75.01 |
| 10,859,342 | B2 * | 12/2020 | Ludlow | F41C 23/16 |
| 10,969,184 | B2 * | 4/2021 | McLeroy | F41A 3/66 |
| 2011/0185618 | A1 * | 8/2011 | Jamison | F41C 23/16 42/75.03 |

* cited by examiner

*Primary Examiner* — Reginald S Tillman, Jr.
(74) *Attorney, Agent, or Firm* — Eversheds Sutherland (US) LLP

(57) ABSTRACT

Systems for attaching a bottom metal to a rifle action. The systems include adjustable pillars disposed within a rifle chassis that may be adjusted in length to accommodate different bottom metal geometries, rifle chassis geometries, and/or different rifle action geometries.

17 Claims, 4 Drawing Sheets

ADJUSTABLE PILLARS FOR RIFLE BOTTOM METAL

CROSS-REFERENCE TO RELATED APPLICATION

This disclosure claims priority to and the benefit of U.S. Provisional Application No. 63/214,463, filed Jun. 24, 2021, which is hereby incorporated by reference herein in its entirety.

FIELD OF THE DISCLOSURE

This disclosure relates generally to firearms and firearm attachments and, in particular, relates to adjustable pillars for securing a bottom metal to a rifle action.

BACKGROUND

Some firearms, such as bolt-action rifles, do not support the use of a magazine without adding an additional component. This component, sometimes referred to as a bottom metal or lower metal, is secured to the rifle action by passing securing bolts through mounting pillars installed within the rifle chassis, thereby converting a bolt-action rifle into a rifle compatible with an interchangeable magazine. Since rifle chassis can vary from manufacturer to manufacturer, or from platform to platform, different mounting pillars and bottom metals exist for nearly every permutation of rifle chassis. Thus, bottom metals must often be custom ordered, or manufactured on a per-customer basis.

Accordingly, improved means of securing a bottom metal to a rifle chassis are needed.

BRIEF DESCRIPTION OF THE DRAWINGS

The detailed description is set forth with reference to the accompanying drawings. The use of the same reference numerals may indicate similar to identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
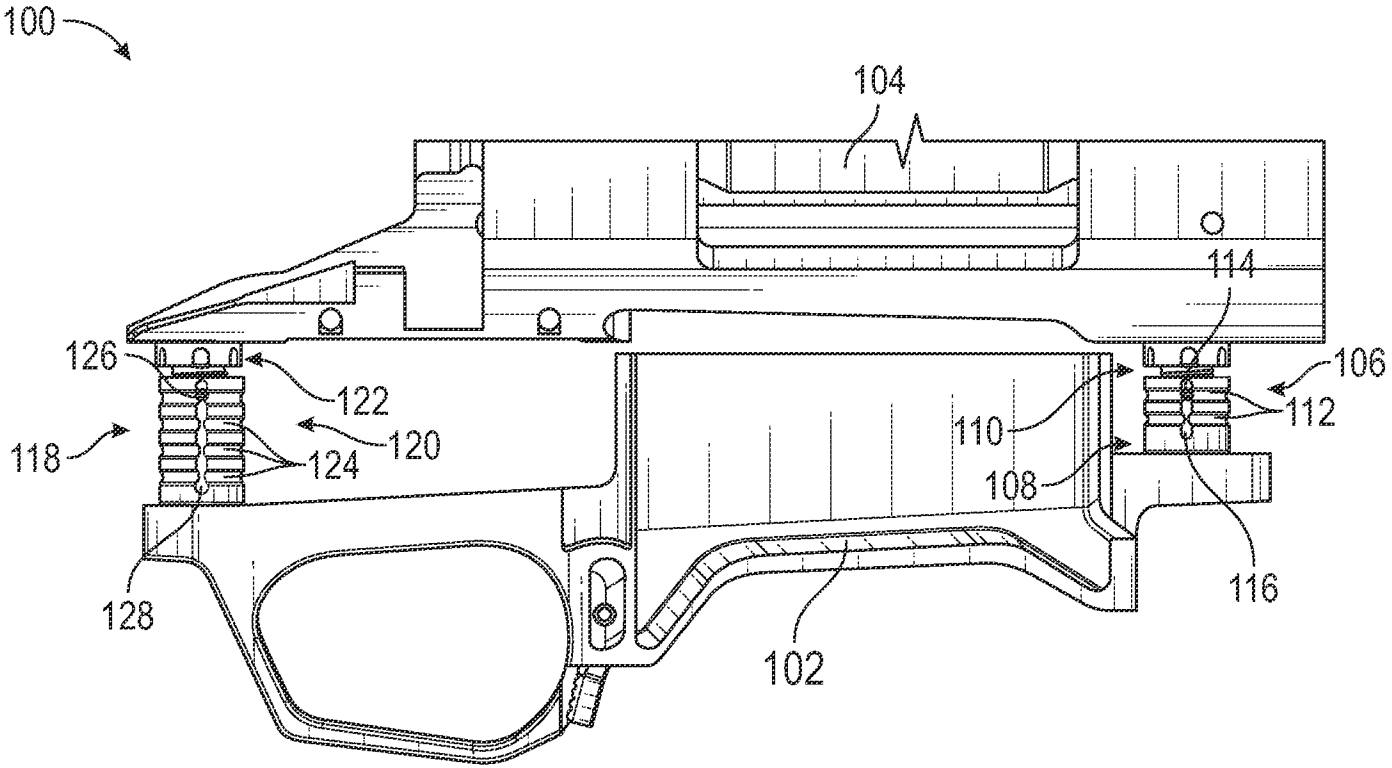
FIG. 1 is a side view of a rifle action and bottom metal in accordance with an embodiment of the disclosure.

Systems for attaching a bottom metal to a rifle action are provided herein including adjustable pillars that advantageously adapt bottom metals of different shapes and geometries to rifle chassis of different shapes and geometries. The embodiments are described in detail herein to enable one of ordinary skill in the art to practice the adjustable pillars, although it is to be understood that other embodiments may be made without departing from the scope of the disclosure.

Throughout this disclosure, various aspects are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6, etc., as well as individual numbers within that range, for example, 1, 2, 3, 4, 5, and 6. This applies regardless of the breadth of the range.

Any known firearm compatible with a bottom metal may be adapted to one or more bottom metals using the adjustable pillars described herein. The decision to recite, depict, or describe any specific type of firearm is merely in the interest of brevity.

Any known material suitable for firearms, firearm accessories, and firearm parts may be used to make the adjustable pillars described herein. For example, the adjustable pillars may be made out of aluminum, steel, another metal, or an alloy thereof. Any suitable material may be used.

Adjustable pillars have been produced that have an upper portion threaded into a lower portion for insertion into a rifle chassis. The adjustable pillars are configured to adapt to different geometries of rifle chassis, rifle actions, and/or bottoms metals.

As used herein, a "rifle action" refers to the functional portion of a firearm that loads a round, locks the round in position, fires the round, and ejects the spent cartridge.

As used herein, a "bottom metal" refers to the portion of a firearm that operably connects to the rifle action through the rifle chassis and adapts the firearm to accept a detachable magazine. Although the term "bottom metal" is used in industry to refer to any component that servers as the floor of the rifle action, the term is used herein specifically to refer to bottom metals that adapt rifles to accept a detachable or interchangeable magazine.

As used herein, a "rifle chassis" refers to the portion of a rifle to which the rifle action and bottom metal are secured. The rifle chassis typically includes, or is entirely comprised of, the rifle stock and may be made out of a variety of materials, including wood, plastic, polymers, metal, or a metal alloy.

Systems for Attaching a Bottom Metal to a Rifle Action

FIG. 1 illustrates a side view of an example system 100 for attaching a bottom metal 102 to a rifle action 104 according to an embodiment of the disclosure. The example system 100 may include a first adjustable pillar 106. The first adjustable pillar 106 may include a lower portion 108 and an upper portion 110 configured to be inserted into and threadably couple to the lower portion 108. The lower portion 108 may include a plurality of circumferential grooves 112 configured to accept an epoxy. The lower portion 108 may also include one or more radial holes 114 configured to accept an epoxy and secure the upper portion 110 within the lower portion 108 by, for example, thread-locking threads on the upper portion 110. The lower portion 108 may also include a plurality of longitudinal grooves 116 configured to accept an epoxy.

The use of relational terms, such as, but not limited to, "top," "bottom," "left," "right," "front," "back," "upward," "downward," "beneath," "underside," "fore," "aft," and the like are used in the written description for clarity in specific reference to the Figures, or to refer the relative disposition of portions of adjustable pillars and/or rifle components, and are not intended to further limit the scope of the invention or the appending claimed. For example, a portion may be "beneath" another portion, but such a portion does not necessarily have to be on the "bottom" as viewed by an observer. Any relative positioning in three-dimensional space of the portions and components of adjustable pillars or other rifle components is contemplated.

In certain embodiments, the system 100 can include a second adjustable pillar 118. The second adjustable pillar 118 may include a lower portion 120 and an upper portion 122 configured to be inserted into and threadably couple to the lower portion 120. The lower portion 120 may include a plurality of circumferential grooves 124 configured to accept an epoxy. The lower portion may also include one or more radial holes 126 configured to accept an epoxy and secure the upper portion 122 within the lower portion 120 by, for example, thread-locking threads on the upper portion 122. The lower portion 120 may also include a plurality of longitudinal grooves 128 configured to accept an epoxy.

In certain embodiments, the lower portion 108 of the first adjustable pillar 106 is configured to be rotatable with respect to the upper portion 110 of the first adjustable pillar 106, thereby changing a length of the first adjustable pillar 106. In certain embodiments, the lower portion 120 of the second adjustable pillar 118 is configured to be rotatable with respect to the upper portion 122 of the second adjustable pillar 118, thereby changing a length of the second adjustable pillar 118.

In certain embodiments, the length of the first adjustable pillar 106 is shorter or lower than the length of the second adjustable pillar 118. In certain embodiments, the plurality of longitudinal grooves 116 of the first adjustable pillar 106 have a longitudinal length shorter than the length of the first adjustable pillar 106, thereby creating a reservoir for epoxy that does not contact either the bottom metal 102 or rifle action 104. In certain embodiments, the plurality of longitudinal grooves 128 of the second adjustable pillar 118 have a longitudinal length shorter than the length of the second adjustable pillar 118, thereby creating a reservoir for epoxy that does not contact either the bottom metal 102 or rifle action 104.

In certain embodiments, the first adjustable pillar 106 has a width less than, equal to, or greater than a width of the second adjustable pillar 118. The relative widths of the first and second adjustable pillars may vary depending on the geometry of the rifle chassis into which the adjustable pillars are set. In certain embodiments, the first and second adjustable pillars are cylindrical. In other embodiments, the first and second adjustable pillars have a polygonal radial cross-section. The first and second adjustable pillars may have the same radial cross-sectional shape, or they may have a different radial cross-sectional shape depending on the geometry of the rifle chassis into which the adjustable pillars are set.

Figure 2B:
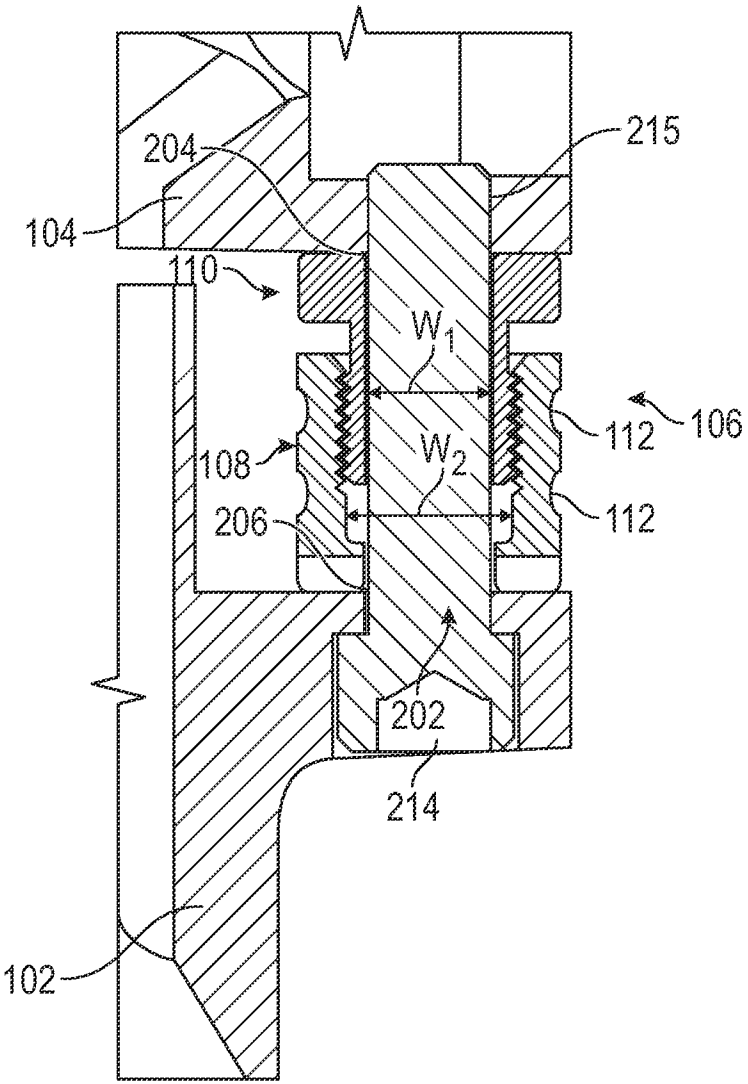
FIG. 2B is a side detail view of a rifle action and bottom metal in accordance with an embodiment of the disclosure.
Figure 2A:
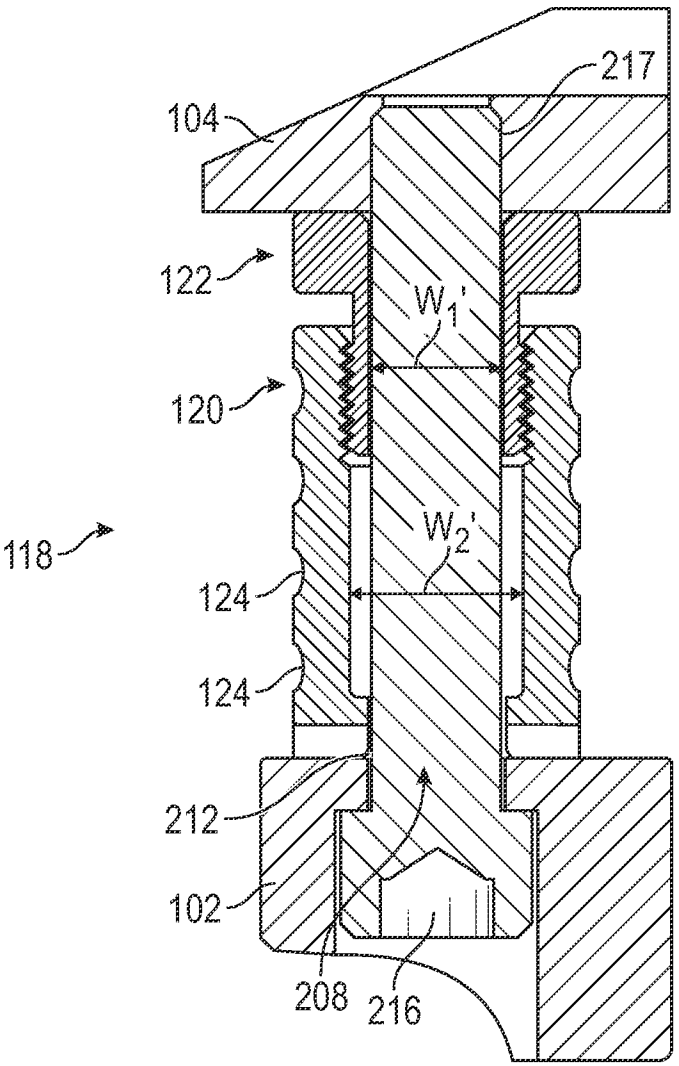
FIG. 2A is a side detail view of a rifle action and bottom metal in accordance with an embodiment of the disclosure.

FIG. 2A illustrates a side view in cross section of the bottom metal 102 and rifle action 104 with first adjustable pillar 106 disposed therebetween. First adjustable pillar 106 may include a longitudinal channel 202 passing through the lower portion 108 and the upper portion 110 of the first adjustable pillar 106. Longitudinal channel 202 may have a first inner width $W_1$ corresponding to an inner width of the upper portion 110 of the first adjustable pillar 106. Longitudinal channel 202 may have a second inner width $W_2$ corresponding to an inner width of the lower portion 108 of the first adjustable pillar 106. The second inner width $W_2$ may be larger than the first inner width $W_1$. The upper portion 110 of the first adjustable pillar 106 may have a chamfered aperture 208 around the longitudinal channel 202, and the lower portion 108 of the first adjustable pillar 106 may have a chamfered aperture 210 around the longitudinal channel 202.

FIG. 2B illustrates a side view in cross section of the bottom metal 102 and rifle action 104 with second adjustable pillar 118 disposed therebetween. Second adjustable pillar 118 may include a longitudinal channel 208 passing through the lower portion 120 and the upper portion 122 of the second adjustable pillar 118. Longitudinal channel 208 may have a first inner width $W_1'$ corresponding to an inner width of the upper portion 122 of the second adjustable pillar 118. Longitudinal channel 208 may have a second inner width $W_2'$ corresponding to an inner width of the lower portion 120 of the second adjustable pillar 118. The second inner width $W_2'$ may be larger than the first inner width $W_1$. The upper portion 122 of the second adjustable pillar 118 may have a chamfered aperture 210 around the longitudinal channel 208, and the lower portion 120 of the second adjustable pillar 118 may have a chamfered aperture 212 around the longitudinal channel 208.

In certain embodiments, the longitudinal channel 202 of the first adjustable pillar 106 and the longitudinal channel 204 of the second adjustable pillar 118 are circular in cross-section. In other embodiments, the longitudinal channels have a polygonal cross-section. The longitudinal channels may have the same radial cross-sectional shape, or they may have a different radial cross-sectional shape.

In some embodiments, a first bolt 214 is passed through the longitudinal channel 202 of the first adjustable pillar 106 and into the rifle action 104 at screw-hole 215. In some embodiments, a second bolt 216 is passed through the longitudinal channel 208 of the second adjustable pillar 118 and into the rifle action 104 at screw-hole 217.

Figure 3:
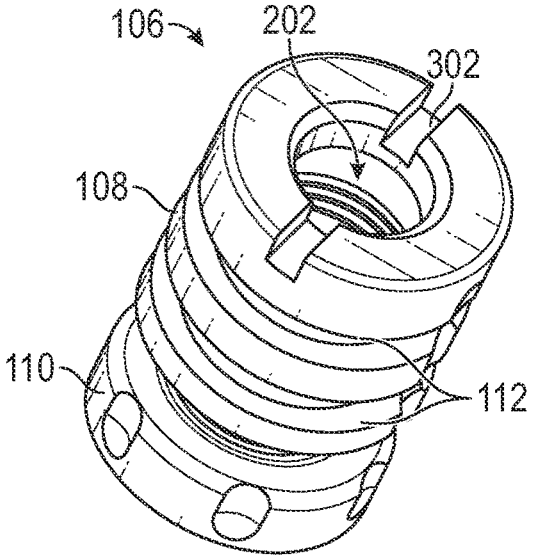
FIG. 3 is a perspective view of an adjustable pillar in accordance with an embodiment of the disclosure.

FIG. 3 illustrates a perspective view of a first adjustable pillar 106 according to an embodiment of the disclosure. Lower portion 108 of the first adjustable pillar 106 may include a radial groove 302 on an end of the lower portion 108 distal to the upper portion. Radial groove 302 may be configured to accept a tool for rotating the lower portion 108 relative to the upper portion 110 of the first adjustable pillar 106, thereby adjusting a length of the first adjustable pillar 106.

Figure 4A:
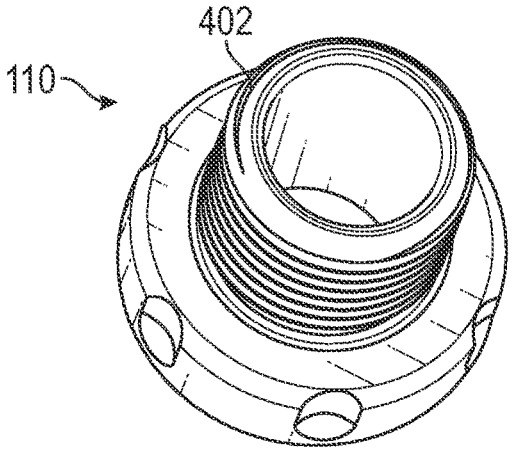
FIG. 4A is a perspective view of an upper portion of an adjustable pillar in accordance with an embodiment of the disclosure.
Figure 4B:
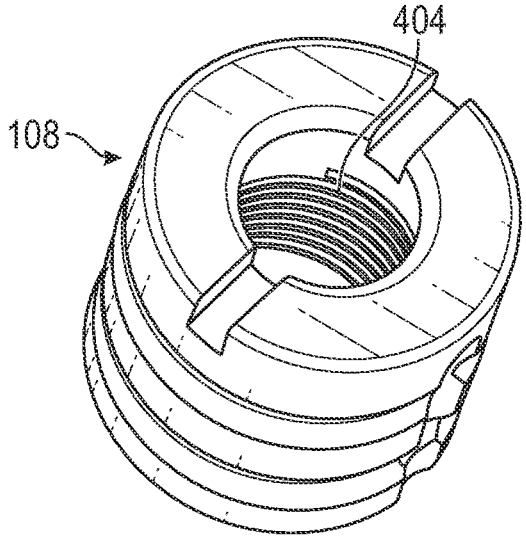
FIG. 4B is a perspective view of a lower portion of an adjustable pillar in accordance with an embodiment of the disclosure.

FIG. 4A illustrates a perspective view of upper portion 110 of first adjustable pillar 106 and FIG. 4B illustrates a perspective view of lower portion 108 of first adjustable pillar 106 according to an embodiment of the disclosure. First threads 402 may be included on upper portion 110 and are configured to threadably couple to second threads 404 on lower portion 108.

While certain embodiments have been described with specific reference to the first adjustable pillar 106 (e.g. FIGS. 3-4B), it is to be understood that a radial groove, first threads, and second threads may be present on second adjustable pillar 118. The decision to describe elements only in reference to the first adjustable pillar is solely in the interest of brevity.

Figure 5:
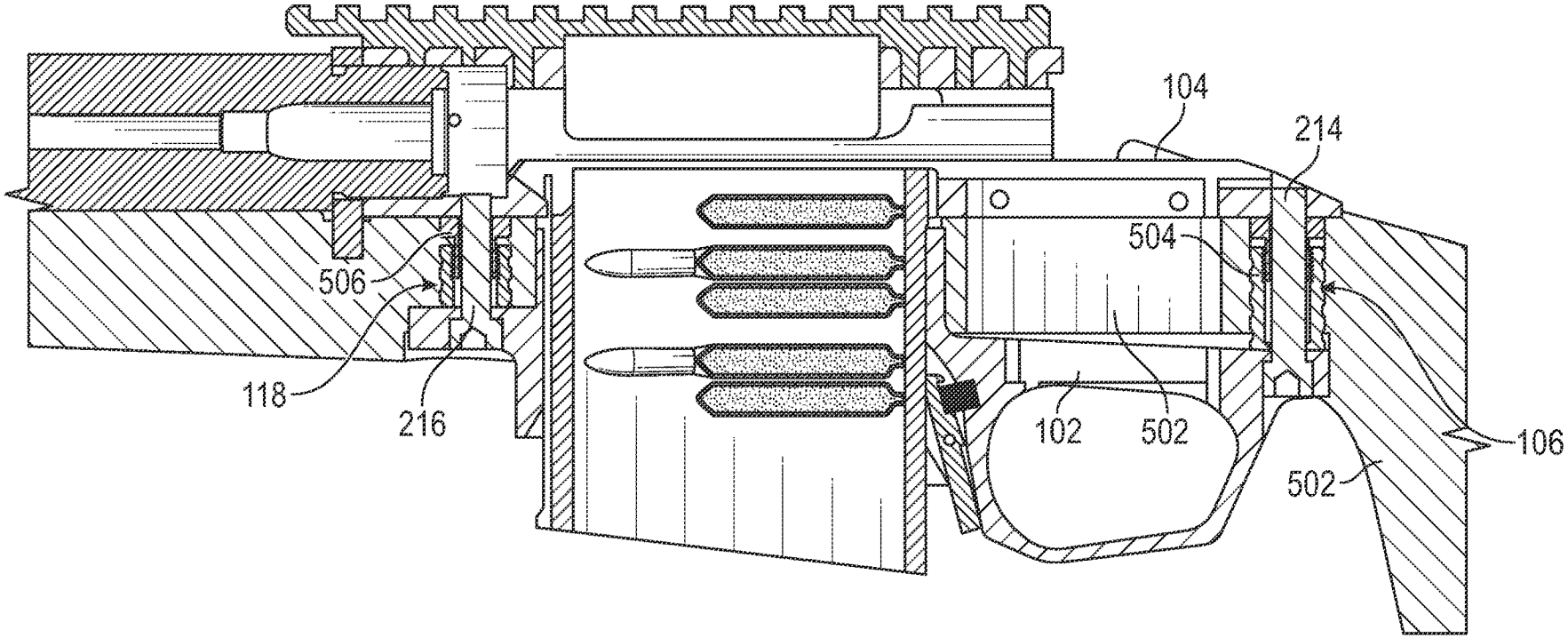
FIG. 5 is a side view in cross section of a rifle in accordance with an embodiment of the disclosure.

FIG. 5 illustrates a side view in cross section of a rifle according to an embodiment of the disclosure. First adjustable pillar 106 is set within rifle chassis 502 at forward hole 506. Second adjustable pillar 118 is set within rifle chassis 502 at rearward hole 504. Bottom metal 102 is secured to rifle action 104 using bolt 214 which passes through first adjustable pillar 106 and into the rifle action and bolt 216 which passes through second adjustable pillar 118.

Methods for Attaching a Bottom Metal to a Rifle Action

Also disclosed herein are methods for attaching a bottom metal to a rifle action. In some embodiments, the method includes providing a rifle chassis that includes a rifle stock and a rifle action. The rifle stock may include a forward hole that corresponds to a forward screw-hole on the rifle action. The rifle stock may also include a rearward hole that corresponds to a rearward screw-hole on the rifle action.

In some embodiments, the method includes inserting a first adjustable pillar into the forward hole in the rifle stock so that an upper surface of the first adjustable pillar contacts the rifle action at the forward screw-hole, and inserting a second adjustable pillar into the rearward hole in the rifle stock so that an upper surface of the second adjustable pillar contacts the rifle action at the rearward screw-hole. The length of the first adjustable pillar may be shorter than a length of the second adjustable pillar depending on the geometry of the rifle chassis, rifle action, and bottom metal. Each of the first adjustable pillar and second adjustable pillar may include an upper portion rotatably coupled to a lower portion using threads such that rotating the lower portion with respect to the upper portion changes the length of the adjustable pillar. Each of the first adjustable pillar and second adjustable pillar may include a longitudinal channel through which a bolt may be passed.

In some embodiments, the method includes adjusting the length of the first adjustable pillar to create an adjusted first adjustable pillar and the length of the second adjustable pillar to create an adjusted second adjustable pillar. Adjusting the length of the first adjustable pillar may include rotating the lower portion of the first adjustable pillar so that the first adjustable pillar changes in length along the threads. Adjusting the length of the second adjustable pillar may include rotating the lower portion of the second adjustable pillar so that the second adjustable pillar changes in length along the threads.

In some embodiments, the method includes removing the adjusted first adjustable pillar and the adjusted second adjustable pillar from the rifle stock before applying an epoxy to the forward hole and the rearward hole. The method may include reinserting the adjusted first adjustable pillar into the forward hole including the epoxy and reinserting the adjusted second adjustable pillar into the rearward hole including the epoxy. The method may include curing the epoxy so set the adjustable pillars within the rifle chassis.

In some embodiments, the method includes securing a bottom metal to the rifle action. The bottom metal may include a forward mounting hole and a rearward mounting hole, and securing the bottom metal to the rifle action may include inserting a forward mounting bolt through the forward mounting hole and the longitudinal channel of the first adjustable pillar and into the forward screw-hole in the rifle action. The method may include inserting a rearward mounting bolt through the rearward mounting hole and the longitudinal channel of the second adjustable pillar and into the rearward screw-hole in the rifle action. In some embodiments, the forward mounting bolt threadably couples to the forward screw-hole and the rearward mounting bolt threadably couples to the rearward screw-hole, thereby securing the bottom metal to the rifle action.

In some embodiments, adjusting the length of the first adjustable pillar includes inserting a tool into a radial groove in the lower portion of the first adjustable pillar and rotating the lower portion of the first adjustable pillar along the threads of the first adjustable pillar. Adjusting the length of the second adjustable pillar may include inserting a tool into a radial groove in the lower portion of the second adjustable pillar and rotating the lower portion of the second adjustable pillar along the threads of the second adjustable pillar.

In some embodiments, adjusting the length of the first adjustable pillar and the second adjustable pillar includes aligning a surface of the lower portion of the first adjustable pillar with a surface of the rifle stock so that the surface of the lower portion of the first adjustable pillar is flush or coincident with the surface of the rifle stock.

In some embodiments, adjusting the length of the first adjustable pillar and the second adjustable pillar includes (i) inserting the first adjustable pillar into the forward hole and the second adjustable pillar into the rearward hole, (ii) positioning the bottom metal against the first adjustable pillar and the second adjustable pillar, (iii) determining a fit for the bottom metal, i.e., determining which adjustable pillar needs to be adjusted and by how much, (iv) removing the bottom metal, (v) adjusting the length of the first adjustable pillar and the second adjustable pillar depending on the fit of the bottom metal from step (iii), and (vi) repeating steps (i) through (v) until the fit for the bottom metal is satisfactory, i.e., the bottom metal is secured to the rifle action through the rifle chassis such that the bottom metal is operable to convert the rifle into a rifle having an interchangeable magazine.

In some embodiments, the first and second adjustable pillars each have one or more radial holes in the respective lower portions configured to accept the epoxy. Applying the epoxy to the forward hole may thread-lock the upper portion of the first adjustable pillar within the lower portion of the first adjustable pillar. Applying the epoxy to the rearward hole may thread-lock the upper portion of the second adjustable pillar within the lower portion of the second adjustable pillar.

In some embodiments, the first adjustable pillar and the second adjustable pillar are configured to reduce or eliminate compression on the rifle stock when the bottom metal is secured to the rifle action.

While the disclosure has been described with reference to a number of embodiments, it will be understood by those skilled in the art that the disclosure is not limited to such embodiments. Rather, the disclosure can be modified to incorporate any number of variations, alterations, substitutions, or equivalent arrangements not described herein, but which are commensurate with the spirt and scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements or functional capabilities. Additionally, while various embodiments of the disclosure have been described, it is to be understood that aspects of the disclosure may include only some of the described embodiments. Accordingly, the disclosure it not to be seen as limited by the foregoing described, but is only limited by the scope of the appended claims.

The invention claimed is:

1. A system for attaching a bottom metal to a rifle action comprising:

a first adjustable pillar comprising:

a lower portion, an upper portion configured to be inserted into and threadably couple to the lower portion, and a longitudinal channel passing through the lower portion and the upper portion, wherein the lower portion comprises a plurality of circumferential grooves configured to accept an epoxy, wherein the lower portion comprises one or more radial holes configured to accept an epoxy and secure the upper portion within the lower portion, and wherein the upper portion and the lower portion comprise a plurality of longitudinal grooves configured to accept an epoxy;

a second adjustable pillar comprising:

a lower portion, an upper portion configured to be inserted into and threadably couple to the lower portion, and a longitudinal channel passing through the lower portion and the upper portion, wherein the lower portion comprises a plurality of circumferential grooves configured to accept an epoxy, wherein the lower portion comprises one or more radial holes configured to accept an epoxy and secure the upper portion within the lower portion, and wherein the upper portion and the lower portion comprise a plurality of longitudinal grooves configured to accept an epoxy;

wherein the lower portion of the first adjustable pillar is configured to be rotatable with respect to the upper portion of the first adjustable pillar so as to change a length of the first adjustable pillar, and wherein lower portion of the second adjustable pillar is configured to be rotatable with respect to the upper portion of the second adjustable pillar so as to change a length of the second adjustable pillar, and wherein the length of the first adjustable pillar is lower than the length of the second adjustable pillar.

2. The system of claim 1, wherein the longitudinal channel of the first adjustable pillar and the longitudinal channel of the second adjustable pillar each have a first inner width corresponding to an inner width of the upper portion, and a second inner width corresponding to an inner width of the lower portion, wherein the second inner width is larger than the first inner width.

3. The system of claim 1, further comprising a first bolt configured to pass through the longitudinal channel of the first adjustable pillar and into the rifle action and a second bolt configured to pass through the longitudinal channel of the second adjustable pillar and into the rifle action.

4. The system of claim 1, wherein the plurality of longitudinal grooves in the first adjustable pillar have a longitudinal length shorter than the length of the first adjustable pillar, and the plurality of longitudinal grooves in the second adjustable pillar have a longitudinal length shorter than the length of the second adjustable pillar.

5. The system of claim 1, wherein the first adjustable pillar has a width less than, equal to, or greater than a width of the second adjustable pillar.

6. The system of claim 1, wherein the first adjustable pillar and/or the second adjustable pillar are cylindrical.

7. The system of claim 1, wherein the first adjustable pillar and/or the second adjustable pillar have a polygonal radial cross-section.

8. The system of claim 1, wherein the longitudinal channel of the first adjustable pillar and/or the second adjustable pillar is circular in cross-section.

9. The system of claim 1, wherein the longitudinal channel of the first adjustable pillar and/or the second adjustable pillar is polygonal in cross-section.

10. The system of claim 1, wherein the upper portion and/or the lower portion of the first adjustable pillar and/or the second adjustable pillar comprises a chamfered aperture around the longitudinal channel.

11. The system of claim 1, wherein the lower portion of the first adjustable pillar and/or the second adjustable pillar comprises a radial groove on an end distal to the upper portion, wherein the radial groove is configured to accept a tool for facilitating rotating the lower portion.

12. A method for attaching a bottom metal to a rifle action, the method comprising:

providing a rifle chassis comprising a rifle stock and a rifle action, wherein the rifle stock comprises a forward hole that corresponds to a forward screw-hole on the rifle action, and a rearward hole that corresponds to a rearward screw-hole on the rifle action, inserting a first adjustable pillar into the forward hole in the rifle stock so that an upper surface of the first adjustable pillar contacts the rifle action at the forward screw-hole, and inserting a second adjustable pillar into the rearward hole in the rifle stock so that an upper surface of the second adjustable pillar contacts the rifle action at the rearward screw-hole, wherein a length of the first adjustable pillar is lower than a length of the second adjustable pillar, wherein the first adjustable pillar and the second adjustable pillar each comprise an upper portion rotatably coupled to a lower portion using threads, and wherein the first adjustable pillar and the second adjustable pillar each comprise a longitudinal channel through the upper portion and the lower portion, adjusting the length of the first adjustable pillar to create an adjusted first adjustable pillar and the length of the second adjustable pillar to create an adjusted second adjustable pillar, wherein adjusting the length of the first adjustable pillar comprises rotating the lower portion of the first adjustable pillar so that the first adjustable pillar changes in length along the threads, and wherein adjusting the length of the second adjustable pillar comprises rotating the lower portion of the second adjustable pillar so that the second adjustable pillar increases in length along the threads, removing the adjusted first adjustable pillar and the adjusted second adjustable pillar from the rifle stock, applying an epoxy to the forward hole and the rearward hole, reinserting the adjusted first adjustable pillar into the forward hole and the adjusted second adjustable pillar into the rearward hole, curing the epoxy, and securing a bottom metal comprising a forward mounting hole and a rearward mounting hole to the rifle action by inserting a forward mounting bolt through the forward mounting hole and the longitudinal channel of the first adjustable pillar, and into the forward screw-hole, and inserting a rearward mounting bolt through the rearward mounting hole and the longitudinal channel of the second adjustable pillar, and into the rearward screw-hole, wherein the forward mounting bolt threadably couples to the forward screw-hole and the rearward mounting bolt threadably couples to the rearward screw-hole, thereby securing the bottom metal to the rifle action.

13. The method of claim 12, wherein adjusting the length of the first adjustable pillar comprises inserting a tool into a radial groove in the lower portion of the first adjustable pillar and rotating the lower portion of the first adjustable pillar along the threads of the first adjustable pillar, and wherein adjusting the length of the second adjustable pillar comprises inserting a tool into a radial groove in the lower portion of the second adjustable pillar and rotating the lower portion of the second adjustable pillar along the threads of the second adjustable pillar.

14. The method of claim 12, wherein adjusting the length of the first adjustable pillar and the second adjustable pillar comprises rotating the lower portion of the first adjustable pillar and the lower portion of the second adjustable pillar so that the lower portion of the first adjustable pillar and the lower portion of the second adjustable pillar have a surface coincident with a surface of the rifle stock.

15. The method of claim 12, wherein adjusting the length of the first adjustable pillar and the second adjustable pillar comprises (i) inserting the first adjustable pillar into the forward hole and the second adjustable pillar into the rearward hole, (ii) positioning the bottom metal against the first adjustable pillar and the second adjustable pillar, (iii) determining a fit for the bottom metal, (iv) removing the bottom metal, (v) adjusting the length of the first adjustable pillar and the second adjustable pillar, and (vi) repeating steps (i) through (v) until the fit for the bottom metal is satisfactory.

16. The method of claim 12, wherein the first adjustable pillar comprises one or more radial holes configured to accept the epoxy, the second adjustable pillar comprises one or more radial holes configured to accept the epoxy, wherein applying the epoxy to the forward hole thread-locks the upper portion of the first adjustable pillar within the lower portion of the first adjustable pillar, and wherein applying the epoxy to the rearward hold thread-locks the upper portion of the second adjustable pillar within the lower portion of the first adjustable pillar.

17. The method of claim 12, wherein the first adjustable pillar and the second adjustable pillar are configured to reduce or eliminate compression on the rifle stock when the bottom metal is secured to the rifle action.

* * * * *